US005700138A

United States Patent [19]

Bevington

[11] Patent Number: 5,700,138

[45] Date of Patent: Dec. 23, 1997

[54] CENTRIFUGAL PUMP

[75] Inventor: Jack T. Bevington, Ashland, Ohio

[73] Assignee: McNeil (Ohio) Corporation, St. Paul, Minn.

[21] Appl. No.: 578,739

[22] Filed: Dec. 26, 1995

Related U.S. Application Data

[63] Continuation-in-part of Ser. No. 517,341, Aug. 21, 1995, Pat. No. 5,549,447.

[51] Int. Cl.[6] ..... F04B 17/00

[52] U.S. Cl. ..... 417/366; 417/371; 417/372; 417/423.3; 417/423.14; 417/424.2

[58] Field of Search ..... 417/366, 371, 417/372, 423.3, 423.14, 424.2, 567

[56] References Cited

U.S. PATENT DOCUMENTS

| | | | |
|---|---|---|---|
| 2,854,595 | 9/1958 | Arutunoff | 417/366 |
| 2,939,400 | 6/1960 | Maynard | 103/87 |
| 3,494,291 | 2/1970 | Carter, Jr. . | |
| 3,667,870 | 6/1972 | Yoshida et al. | 417/357 |
| 4,465,437 | 8/1984 | Jensen et al. | 417/366 |
| 4,475,873 | 10/1984 | Jensen et al. . | |
| 4,484,862 | 11/1984 | Jensen . | |
| 4,773,822 | 9/1988 | Jensen et al. . | |
| 4,930,996 | 6/1990 | Jensen et al. . | |
| 4,981,420 | 1/1991 | Jensen et al. | 417/423.3 |
| 5,028,218 | 7/1991 | Jensen et al. | 417/366 |
| 5,037,277 | 8/1991 | Tan | 417/567 |
| 5,332,369 | 7/1994 | Jensen . | |

FOREIGN PATENT DOCUMENTS

| | | | |
|---|---|---|---|
| 24123 | 10/1962 | Germany | 417/371 |
| 58-13196 A | 1/1983 | Japan | F04D 29/06 |

*Primary Examiner*—Timothy Thorpe
*Assistant Examiner*—Cheryl J. Tyler
*Attorney, Agent, or Firm*—Renner, Kenner, Greive, Bobak, Taylor & Weber

[57] ABSTRACT

A submersible centrifugal pump (10) includes a casing (11) which houses a motor (13) and a pump assembly (14). A shaft (12) which carries the impeller (37) portion of the pump assembly (14) is driven by the motor (13) to draw fluid, in which the pump (10) is immersed, into the casing (11) in one embodiment through inlet ports (38) to be transferred to the pump assembly (14) and thereby pumped to a remote location. The shaft (12) has an axial bore (40) therein which is open at the bottom (41) to receive fluid. That fluid moves upwardly within the shaft (12) and passes out through radial bores (43) to join with the fluid received from the inlet ports (38). As such, internal fluid positioned in a chamber (23) is cooled by the fluid passing through the shaft (12) and that internal fluid in turn maintains the components in the casing (11) cool. In another embodiment, a submersible centrifugal pump (50) has inlet ports (51) formed near the top of its discharge bowl (15). The inlet fluid travels in axial passageways (52) to the inlet side of the pump assembly (14).

19 Claims, 2 Drawing Sheets

CENTRIFUGAL PUMP

CROSS-REFERENCE TO RELATED APPLICATION

This application is a continuation-in-part of patent application Ser. No. 08/517,341, which was filed on Aug. 21, 1995, which is now U.S. Pat. No. 5,549,447.

TECHNICAL FIELD

This invention relates to centrifugal pumps of the type, for example, that transfer water from a well to a domestic or commercial establishment. More particularly, this invention relates to a novel fluid inlet for such a pump which also includes a system for cooling the motor and other components of such a pump.

BACKGROUND ART

Submersible pumps which have a motor-driven shaft that carries pump components are well known in the art. A prevalent problem with such pumps, however, is the manner in which the fluid is received into the pump casing. Such is usually accomplished at a fluid inlet section positioned between the motor components and the pump assembly. Traditionally, the fluid will be drawn radially inwardly through a plurality of holes provided in the cylindrical pump casing at the inlet section. While providing an adequate pump inlet, such holes have a high tendency to clog, not only because of their often close proximity to the inner walls of the well in which the plump may be positioned, but also because the casing of the pump often comes into contact with the well walls as it is being inserted into the well. As such, mineral accumulations on the well walls often clog the traditional inlet holes and thus an essentially new, or newly inserted pump, immediately is fraught with the inefficiencies of a clogged inlet, even before it has been put into use.

Another prevalent problem with prior art submersible pumps relates to the overheating thereof resulting in the potential failure of the internal motor and bearing components. At one time, such components were immersed in an oil bath which was generally adequate to maintain the components cool enough to avoid failure while pumping water from a well to a remote location. However, with such oil-filled pumps, there is always the environmental and safety hazard of oil leaking into the well water.

As a result, more recently, internally confined water has replaced oil as the more standard cooling medium for submersible pumps. However, while such solves any environmental or safety problems, because the heat capacity of water is less than that of oil, the cooling efficiency of water-cooled pumps is far lower than that of oil-cooled pumps. Moreover, when water-cooled submersible pumps are operated at high speeds on a fairly continuous basis, the internal water churns so fast that, and is heated to the extent that, it may actually boil and turn to steam which, in turn, eliminates the hydrodynamic motor bearing film causing system failure.

In an effort to cool the internal water, some attempts have been made to circulate that water in the annulus between a hollow tube positioned in a hollow drive shaft. The warm water is pumped up in the annulus and is thereby exposed, near the top thereof, to the cooler well water. The circulating internal water then moves down the tube and back to the area of the hot motor. This elaborate system, while dissipating some heat, does not totally solve the problem and is not cost-effective.

DISCLOSURE OF THE INVENTION

It is thus an object of the present invention to provide a centrifugal pump with a unique inlet opening arrangement.

It is another object of the present invention to provide a centrifugal pump, as above, in which the inlet opening arrangement is not susceptible to clogging.

It is an additional an object of the present invention to provide a centrifugal pump, as above, with a system for cooling the same.

It is yet another object of the present invention to provide a centrifugal pump, as above, wherein the cooling medium is internal water.

It is a further object of the present invention to provide a centrifugal pump, as above, which utilizes the water being pumped as the means to maintain the internal water cool.

It is a still further object of the present invention to provide a centrifugal pump, as above, which permits movement of the water being pumped up through the shaft of the pump and to the pump outlet while at the same time cooling the surrounding internal water.

These and other objects of the present invention, as well as the advantages thereof over existing prior art forms, which will become apparent from the description to follow, are accomplished by the improvements hereinafter described and claimed.

In general, a pump which is adapted to be submersed in the fluid which is to be pumped to a remote location includes a casing which houses a motor and a pump assembly. An axially extending shaft is driven by the motor and carries a portion of the pump assembly. Fluid is permitted to axially enter the pump to be axially discharged from the pump to the remote location.

In one embodiment, the fluid axially enters the pump through openings formed in a discharge bowl located at the top of the casing. The fluid then passes through axial passageways and is received at the inlet area of the pump assembly. In another embodiment, fluid enters through radial openings formed in the casing adjacent to the inlet area of the pump assembly.

In both embodiments, fluid also enters through an axial bore formed in the shaft. Such fluid passes through radial bores also formed in the shaft to mix with the fluid at the inlet area of the pump assembly. The fluid passing through the axial bore in the shaft is also utilized to cool the components inside of the casing.

Preferred exemplary submersible centrifugal pumps incorporating the concepts of the present invention are shown by way of example in the accompanying drawing without attempting to show all the various forms and modifications in which the invention might be embodied, the invention being measured by the appended claims and not by the details of the specification.

PREFERRED EMBODIMENTS FOR CARRYING OUT THE INVENTION

Figure 1:
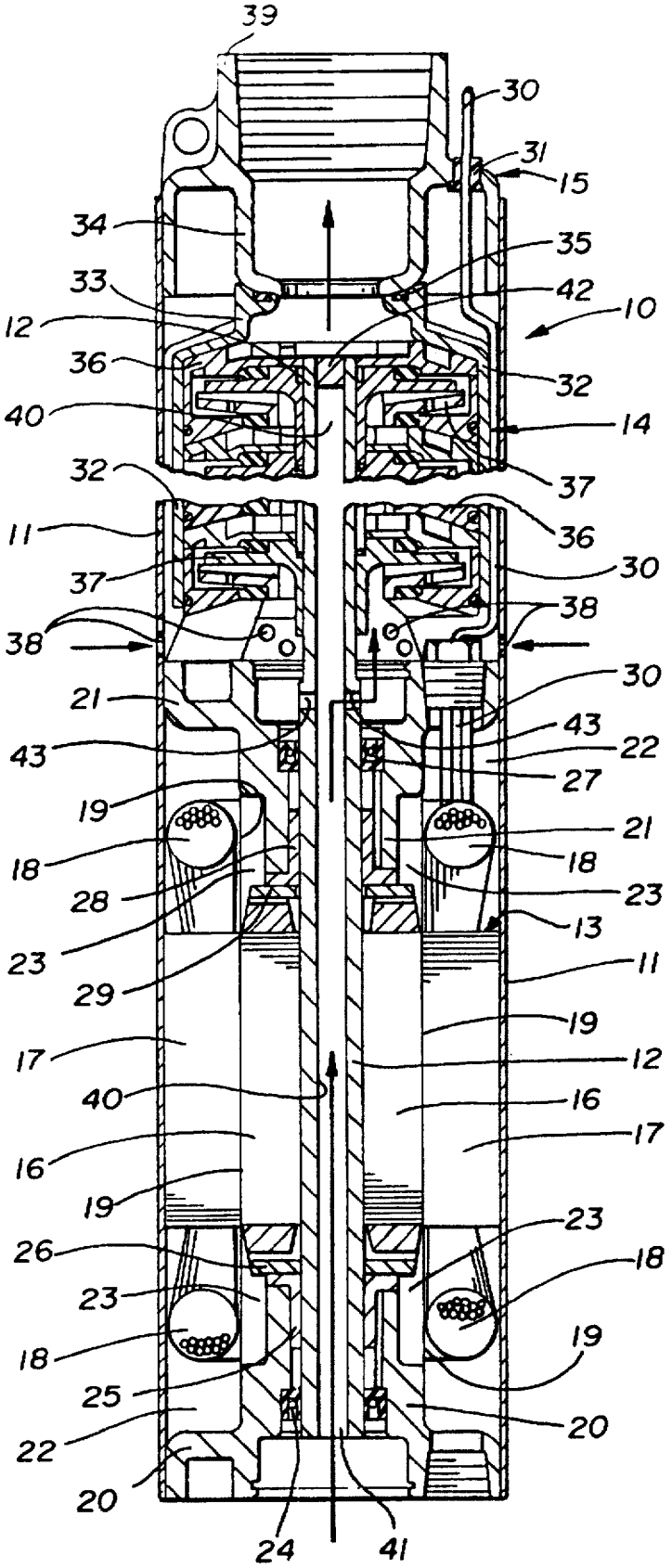
FIG. 1 is a fragmented, longitudinal sectional view of a submersible centrifugal pump made in accordance with the one embodiment of the present invention.

A pump made in accordance with one embodiment of the present invention is shown in FIG. 1 and is indicated generally by the numeral 10. Pump 10 is adapted to be submersed in a fluid, for example, water in a well, to move water from the well to a remote location. Pump 10 includes an outer cylindrical casing 11 which houses a longitudinally extending, axial shaft 12 rotatedly driven by a motor assembly generally indicated by the numeral 13. Pump 10 also includes a pump assembly positioned near the upper end of shaft 12 and generally indicated by the numeral 14 which moves the well water through a discharge bowl generally indicated by the numeral 15 to the remote location.

Motor assembly 13 includes a conventional rotor 16, which rotatably drives shaft 12, and a stator 17 having windings 18. Stator 17 is isolated from rotor 16 by a thin, cylindrical inner liner 19 spaced from and concentric with casing 11. Motor assembly 13 is closed at its lower end by a conventional bearing housing 20 and at its upper end by an essentially identical bearing housing 21. The annulus 22 formed between liner 19 and casing 11, and axially closed by housings 20 and 21, which annulus 22 confines stator 17 and its windings 18, is preferably filled with an epoxy material. Also, as will hereinafter be discussed in more detail, the area 23 or chamber formed within liner 19, is also axially closed by housings 20 and 21, and is filled with internal cooling water or other fluid.

Motor assembly 13 also includes a conventional lower shaft seal 24 between housing 20 and shaft 12, lower shaft bearings 25, and a lower thrust washer 26. Similarly, an upper shaft seal 27 is provided between housing 21 and shaft 12, and upper shaft bearings 28 and an upper thrust washer 29 are also provided, all of which are conventional items. Motor assembly 13 is provided with its electrical power via a power cord 30 which extends from a power source at a remote location, through a grommet 31 in a wall of discharge bowl 15, and then within casing 11 to motor windings 18.

Pump assembly 14 includes a cartridge housing 32 having an upper lip 33 which is sealed against the lower end 34 of discharge bowl 15, as by O-ring 35. Cartridge 32 carries a plurality of conventional stationary diffusers 36 which axially alternate with a like plurality of conventional impellers 37 which are carried by and rotate with shaft 12. Each impeller/diffuser combination forms a pump stage, and pump 10 may be provided with any number of pump stages dependent on the pump size requirements for a particular application.

In this embodiment, water from the well or other source in which pump 10 may be submersed passes through casing 11 at a fluid inlet area located between motor assembly 13 and pump assembly 14. Thus, as shown, a plurality of inlet conventional openings 38 may be provided circumferentially around casing 11. Upon rotation of shaft 12 by motor assembly 13, pump assembly 14 will draw water radially inwardly through openings 38 and the impeller/diffuser stages will pump the water axially upwardly through the lower end 34 of discharge bowl 15. The upper end 39 of discharge bowl 15 can be connected to a discharge conduit which transfers the water to a remote location.

As pump 10 so operates, a great deal of heat is built up on the inside of casing 11, particularly at the area of motor assembly 13. The fluid in confined area 23 is intended to maintain the motor components, including bearings 25 and 28, at a tolerable temperature. However, at high speeds and over rather continual periods of use, this cooling fluid may not alone be able to dissipate the heat generated by the motor rotating the shaft.

To solve this problem, shaft 12 is provided with an axial bore 40 which is open at its bottom end 41 and preferably closed at its top end by means of a set screw 42 or the like. The bottom end 41 of bore 40 is thus generally coincident with the bottom of bearing housing 20 and is exposed to the water in the well or other area in which pump 10 is submerged. This water is, of course, typically much cooler than any of the pump components and cooler than the fluid confined in area 23. Shaft 12 is also provided with a plurality of bores 43 extending radially therethrough at an axial location generally adjacent to the fluid inlet area, that is, axially near inlet openings 38. Thus, axial bore 40 communicates with the fluid inlet area through radial bores 43.

Upon the operation of pump 10, not only is external water drawn in through inlet openings 38, but also due to the centrifugal force, the suction of pump assembly 14, and the fact that warmer water will rise, external water is drawn in through the bottom end 41 of bore 40 and passes out through the radial bores 43 where it mixes with the water in the fluid inlet area and passes through pump assembly 14. As such, this circulation of continually new, fresh, cool water, cools shaft 12 and its surrounding elements, including the internal water in area 23. It should also be appreciated that the system would also operate to circulate cool well water if shaft 12 were not closed at its top end 42 and if radial bores 43 were eliminated. In this instance, the flow would reverse, that is, well water would flow through shaft 12 from top to bottom. The water would be received through inlet openings 38, moved through pump assembly 14 to the top of shaft 12, and then transferred through shaft 12 and out bottom opening 41. In either event, the internal water is maintained substantially cooler than previously heretofore known thereby maintaining bearings 25 and 28 as well as the other components of motor assembly 13 more safely cool.

In fact, actual testing has demonstrated the dramatic effect of the cooling system aspect of the present invention. For example, a prior art pump was run at maximum amperage and at 10,000 RPMS and the temperature of the internal fluid was measured at one hour intervals. The following data was observed:

| Elapsed Time | Temperature |
|---|---|
| Start-Up | 86° F. |
| 1 Hour | 120° F. |
| 2 Hours | 220° F. |
| 3 Hours | 250° F. |
| 3 Hours, 5 minutes | Pump Failure |

Running the same test for pump 10 of the present invention resulted in the following observed temperatures of the fluid in area 23:

| Elapsed Time | Temperature |
|---|---|
| Start-Up | 86° F. |
| 1 Hour | 110° F. |
| 2 Hours | 120° F. |
| 3 Hours | 126° F. |
| 4 Hours | 130° F. |
| 5 Hours | 127° F. |
| 6 Hours | 131° F. |
| 16 Hours | 130° F. |
| 17 Hours | 127° F. |
| Test Terminated | |

It can readily be seen that the fluid temperature for the pump of the present invention stabilized at a temperature approximately 120° F. less than the maximum temperature observed just prior to failure of the prior art pump.

Figure 2:
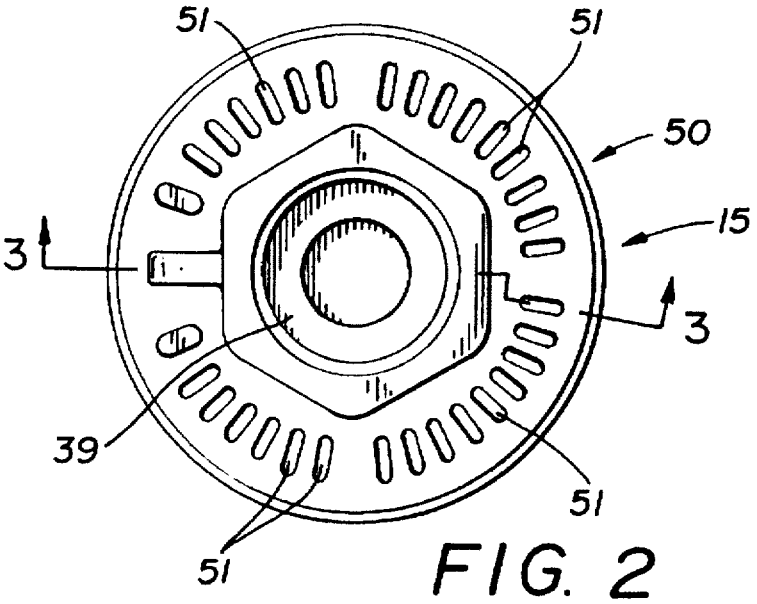
FIG. 2 is a top plan view of a submersible centrifugal pump made in accordance with another embodiment of the present invention.
Figure 3:
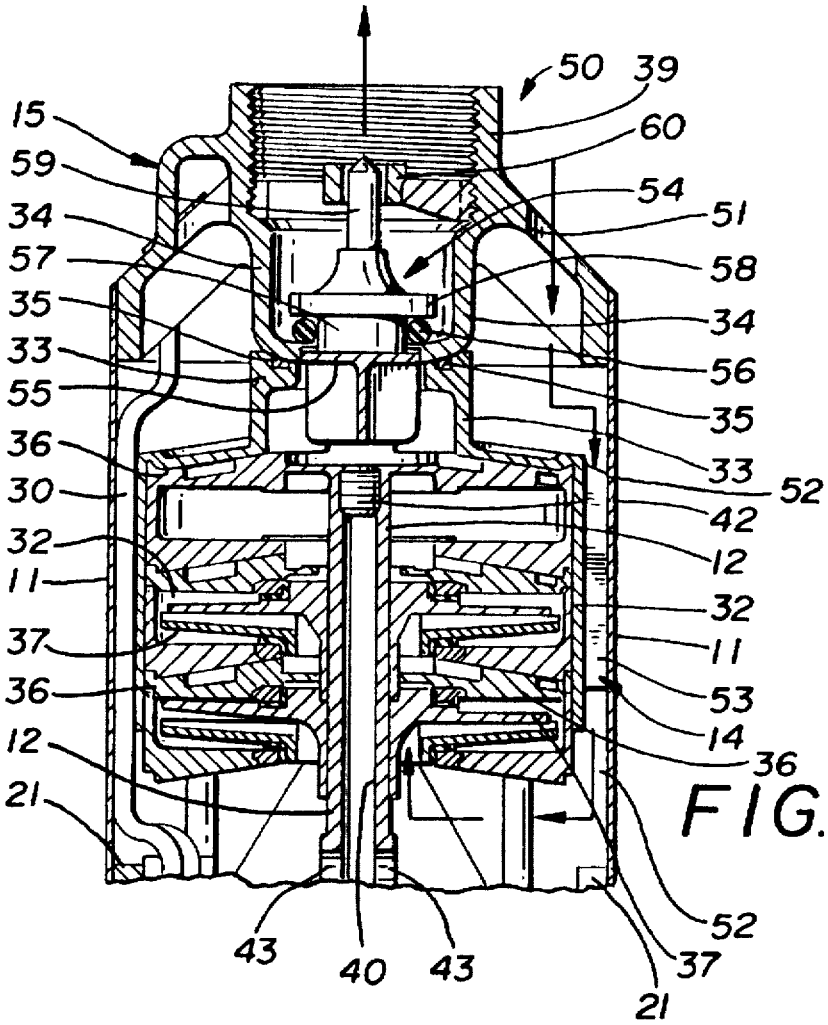
FIG. 3 is a fragmented generally longitudinal sectional view taken substantially along line 3—3 of FIG. 2.

An alternative embodiment of a submersible centrifugal pump made in accordance with another concept of the present invention is indicated generally by the numeral 50 and is shown in FIGS. 2 and 3. It is to be understood that the components of pump 50, not shown in FIG. 3, can be identical to those of pump 10 shown in FIG. 1. Moreover, for those components of pump 50 shown in FIG. 3 which are identical in function, if not structure, to those of pump 10, identical reference numerals have been applied. Thus, shaft 12 with its axial bore 40 carries pump assembly 14 and provides water to the inlet area through radial bores 43.

However, conventional inlet openings 38 are not provided in this embodiment. Rather, a plurality of circumferentially spaced openings 51 are provided near to the top of discharge bowl 15 to allow water to enter therethrough and pass into passageways 52 axially formed in the circumferential space between casing 11 and pump cartridge housing 32. Moreover, passageways 52 are somewhat circumferentially separated by ribs 53 which can be formed on housing 32 and which maintain housing 32 within casing 11. Thus, the input fluid will pass downwardly in passageways 52 between adjacent ribs 53 and between casing 11 and housing 32 to mix at the pump inlet area with the water received through shaft bores 43. Because unlike openings 38, openings 51 are at the top of pump 50, they are less susceptible to being clogged as are openings 38 which were generally adjacent to the internal side of the walls of the well.

The fluid will then be directed by pump assembly 14 upwardly and out through discharge bowl 15 to the remote source. In this regard, in the embodiment of FIG. 3, pump 50 is also shown as having a poppet check valve assembly, generally indicated by the numeral 54, in the discharge line. Valve assembly 54 includes a discharge closure element 55 normally seated within the discharge opening at the bottom of lower end 34 of discharge bowl 15. An o-ring 56 is received around valve body 57 and is held in place against the bottom of lower end 34 of discharge bowl 15 by a collar 58. A valve guide 59 extends upwardly from collar 58 and through a retainer 60 carried in the upper discharge end 39 of bowl 15. As such, when fluid is flowing through pump 50, closure element 55 is lifted to open the discharge line with such movement being laterally or radially confined by guide 59 and retainer 60. When flow ceases, valve 54 moves back to the FIG. 3 position with o-ring 56 preventing any backflow.

It should thus be apparent that a pump made in accordance with the concepts of the present invention accomplishes the objects of the invention and otherwise substantially improves the submersible centrifugal pump art.

What is claimed is:

1. Apparatus adapted to be submersed in a fluid and to pump the fluid to a remote location comprising a casing, a discharge bowl at the top of said casing through which the fluid may pass to the remote location, a pump assembly within the casing, said pump assembly having an inlet area on one side thereof and a discharge area on the other side thereof adjacent to said discharge bowl, a motor within said casing, a shaft driven by said motor and carrying a portion of said pump assembly, fluid inlet openings formed through said discharge bowl, and passageways between said inlet openings and said inlet area of said pump assembly so that fluid passes downwardly through said openings and said passageways to said inlet area to be pumped by said pump assembly through said discharge bowl to the remote location.

2. Apparatus according to claim 1 further comprising a housing for said pump assembly, wherein said housing is spaced from said casing, and wherein said passageways are formed in the space between said housing and said casing.

3. Apparatus according to claim 2 further comprising rib members extending inwardly between said casing and said housing, wherein said passageways are also formed between said rib members.

4. Apparatus according to claim 1 further comprising a valve between said discharge area of said pump assembly and said discharge bowl.

5. Apparatus according to claim 4 wherein said valve includes a guide member and further comprising a retainer formed in said discharge bowl and receiving said guide member therethrough.

6. Apparatus according to claim 1 further comprising an axial bore in said shaft adapted, at one end thereof, to receive fluid therein, the fluid moving in said axial bore to cool the inside of said casing.

7. Apparatus according to claim 6 wherein said one end of said axial bore is open and exposed to the fluid.

8. Apparatus according to claim 6 further comprising a chamber formed in said housing, and a liquid in said chamber, the fluid in said axial bore cooling said liquid.

9. Apparatus according to claim 6 further comprising radial bores in said shaft and communicating with said axial bore.

10. Apparatus according to claim 9 wherein said radial bores are generally adjacent to said inlet area of said pump assembly so that the fluid moving in said axial bore may pass through said radial bores and join with the fluid flowing through said passageways.

11. Apparatus adapted to be submerged in a fluid and to pump the fluid to a remote location comprising an axially extending casing having a top surface, a pump assembly within the casing, said pump assembly having an inlet area on one axial side thereof and a discharge area on the other axial side thereof, a motor within said casing, an axially extending shaft driven by said motor and carrying a portion of said pump assembly, and inlet means to permit the fluid to be transferred to the remote location to axially enter the apparatus through said top surface to be axially discharged from the apparatus by said pump assembly.

12. Apparatus according to claim 11 further comprising means to transmit the fluid from said inlet means to said inlet area of said pump assembly.

13. Apparatus according to claim 12 wherein said inlet means also includes an axial bore in said shaft and said means to transmit includes radial bores in said shaft communicating with said axial bore.

14. Apparatus according to claim 13 wherein said inlet means also includes radial openings in said casing.

15. Apparatus according to claim 12 wherein said top surface includes discharge bowl at the top of said casing through which the fluid is axially discharged to the remote location, said inlet means including apertures in said discharge bowl.

16. Apparatus according to claim 15 wherein said means to transmit includes axial passageways between said apertures and said inlet area of said pump assembly.

17. Apparatus according to claim 16 wherein said inlet means also includes an axial bore in said shaft and said means to transmit also includes radial bores in said shaft communicating with said axial bore.

18. Apparatus according to claim 16 further comprising a housing for said pump assembly, wherein said housing is spaced from said casing, and wherein said passageways are formed in the space between said housing and said casing.

19. Apparatus according to claim 18 further comprising rib members extending inwardly between said casing and said housing, wherein said passageways are also formed between said rib members.

* * * * *